US011130504B2

(12) United States Patent
Coester et al.

(10) Patent No.: US 11,130,504 B2
(45) Date of Patent: Sep. 28, 2021

(54) PNEUMATIC PROPULSION SYSTEM FOR HIGH CAPACITY TRANSPORT OF PASSENGERS AND/OR CARGO

(71) Applicant: AEROM REPRESENTAÇÕES E PARTICIPAÇÕES LTDA., Porto Alegre (BR)

(72) Inventors: Marcus Coester, Porto Alegre (BR); Diego Abs Da Cruz, Porto Alegre (BR); Oscar Hans Wolfgang Coester, Porto Alegre (BR)

(73) Assignee: AEROM REPRESENTAÇÕES E PARTICIPAÇÕES LTDA.

( * ) Notice: Subject to any disclaimer, the term of this patent is extended or adjusted under 35 U.S.C. 154(b) by 329 days.

(21) Appl. No.: 16/398,373

(22) Filed: Apr. 30, 2019

(65) Prior Publication Data

US 2020/0164900 A1 May 28, 2020

(30) Foreign Application Priority Data

Nov. 23, 2018 (BR) ..... 1020180741446

(51) Int. Cl.
*B61B 13/12* (2006.01)

(52) U.S. Cl.
CPC ..... *B61B 13/122* (2013.01)

(58) Field of Classification Search
CPC ..... B65G 51/02; B65G 51/03; B65G 51/18; B65G 54/00; B65G 2207/06;
(Continued)

(56) References Cited

U.S. PATENT DOCUMENTS 3,013,505 A * 12/1961 Burke, Jr. ..... B61B 13/08 104/134
3,333,550 A * 8/1967 Gorham ..... B61B 13/08 104/23.2

(Continued)

FOREIGN PATENT DOCUMENTS

BR PI 7703372 12/1978
BR PI 7906255 8/1980

(Continued)

*Primary Examiner* — Joseph A Dillon, Jr.
(74) *Attorney, Agent, or Firm* — Ostrolenk Faber LLP

(57) ABSTRACT

A propulsion system is composed of vehicles with four wheels having one of the axles connected to a pylon attached to the propulsion plate. The vehicles move over rails of elevated guideways supported by pillars. The top of the elevated guideways has longitudinal slots for allowing passage of pylons of propulsion plates. The elevated guideway is dual and has two power propulsion units for propulsion operation in a push and/or pull mode, one for each elevated guideway. The power propulsion units are installed inside the machine rooms under the pavement of the sob passenger stations supported on pillars. The power propulsion units are connected to the elevated guideways by means of connection ducts. Secondary propulsion ducts are disposed in parallel with the propulsion duct and integrated with its respective flow direction valve which allows that the air flow generated by the power propulsion unit is discharged in the propulsion duct in two distinct positions. The pneumatic propulsion arrangement is completed by isolation valve sets of the guideway section, atmospheric valve sets, set of four air flow control valves mounted in the connection ducts of the power propulsion units and flow direction valves.

7 Claims, 15 Drawing Sheets

Figure 1:
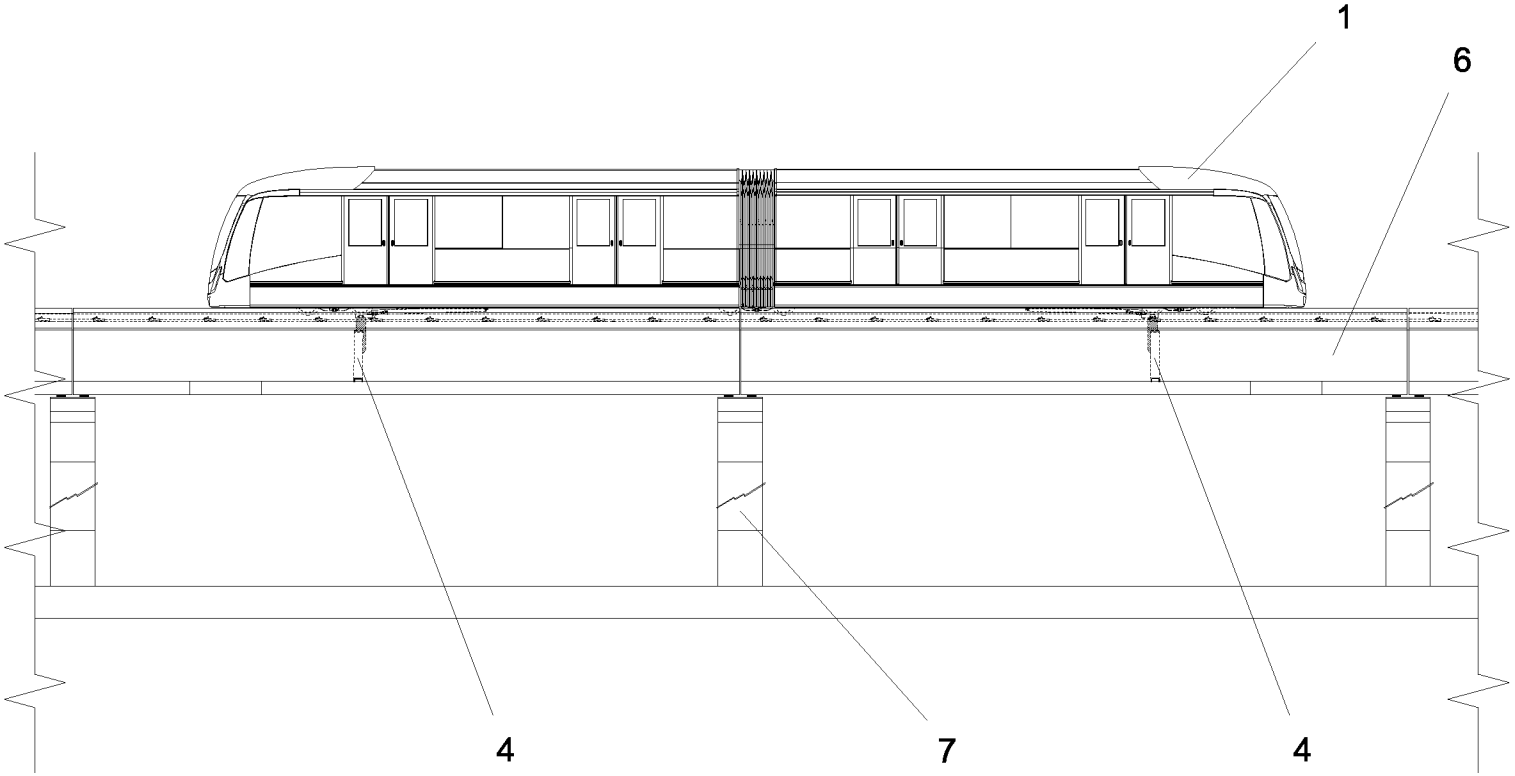

(58) Field of Classification Search
CPC ..... B65G 2812/16; B61B 5/00; B61B 5/02; B61B 5/025; B61B 13/00; B61B 13/12; B61B 13/122; B60V 3/04
USPC ..... 406/87–88, 191–192; 414/676; 104/28, 104/155, 156, 157, 158, 159, 160
See application file for complete search history.

(56) References Cited

U.S. PATENT DOCUMENTS 3,352,512 A * 11/1967 James, Sr. ..... B61B 13/122 104/138.1
3,368,496 A * 2/1968 Falk ..... B61B 13/00 104/18
3,403,634 A * 10/1968 Crowder ..... B61D 19/005 104/138.1
3,408,113 A * 10/1968 Bouladon ..... B65G 51/36 406/19
3,467,024 A * 9/1969 Broniewski ..... B60V 3/04 104/134
3,543,685 A * 12/1970 Rosciszewski ..... B61B 5/025 104/23.2
3,547,042 A * 12/1970 O'Connor ..... B61C 11/06 104/155
3,621,787 A * 11/1971 Giraud ..... B60V 3/04 104/23.2
3,648,620 A * 3/1972 Bertin ..... B60V 3/04 105/63
3,687,083 A * 8/1972 Brown ..... B62D 65/00 104/155
3,722,424 A * 3/1973 Van Veldhuizen .... B61B 13/122 104/23.2
3,771,463 A * 11/1973 Smoot ..... B61L 3/08 104/155
3,796,164 A * 3/1974 Nogi ..... B60L 13/03 104/138.1
3,842,746 A * 10/1974 Kleven ..... B61L 13/002 104/155
3,871,300 A * 3/1975 Perrott ..... B62D 1/265 104/130.02
3,999,487 A * 12/1976 Valverde ..... B61B 13/10 104/138.1
4,017,039 A * 4/1977 Carstens ..... B65G 51/08 406/105
4,078,498 A * 3/1978 Futer ..... B65G 51/02 104/138.1
4,823,704 A * 4/1989 Fujita ..... E01B 25/00 104/247
5,199,358 A * 4/1993 Barratt ..... B61B 5/025 104/139
5,359,941 A * 11/1994 DeLorean ..... B60V 3/04 104/124
5,473,233 A * 12/1995 Stull ..... B60L 13/10 104/27
5,566,620 A * 10/1996 Siewert ..... E01B 25/00 104/124
5,845,582 A * 12/1998 Coester ..... B61B 13/122 104/156
6,178,892 B1 * 1/2001 Harding ..... B60V 3/04 104/119
6,213,026 B1 * 4/2001 Coester ..... B61B 13/122 104/140
6,279,485 B1 * 8/2001 Schlienger ..... B60V 3/04 104/138.1
6,389,983 B1 * 5/2002 Coester ..... B61B 13/122 104/138.1
6,393,994 B1 * 5/2002 Azimi ..... B61B 13/10 104/138.1
6,574,530 B1 * 6/2003 Bertone ..... B66B 21/10 198/321
8,146,508 B2 * 4/2012 Flynn ..... B61B 13/10 104/138.1
8,448,577 B2 * 5/2013 Coester ..... B61B 13/122 104/124
8,468,949 B2 * 6/2013 Kwon ..... B61B 13/10 104/155
10,220,972 B2 * 3/2019 Grip ..... B65D 19/36
10,745,160 B2 * 8/2020 Grip ..... B65B 31/04
2004/0244635 A1 * 12/2004 Schlienger ..... B61B 13/122 104/138.1
2011/0056405 A1 * 3/2011 Coester ..... B61B 13/122 104/124
2012/0168525 A1 * 7/2012 Kono ..... E01B 25/28 238/17
2016/0121908 A1 * 5/2016 Ahmad ..... B65G 51/02 406/50
2018/0057028 A1 * 3/2018 Parsley ..... B61L 27/0033
2018/0086353 A1 * 3/2018 Holbrooke ..... G05D 1/0293
2019/0225241 A1 * 7/2019 Coester ..... B61C 11/00
2020/0079404 A1 * 3/2020 Tao ..... B60M 1/30

FOREIGN PATENT DOCUMENTS

BR 8301706 A 11/1984
BR 8503504 A 9/1986
BR PI 9502056-0 A 8/1997
BR PI 9814160-0 A 9/2000
BR PI 9912112-3 A 5/2001
BR PI 0805188-7 A2 2/2012
BR PI 0901119-6 A2 5/2012

* cited by examiner

PNEUMATIC PROPULSION SYSTEM FOR HIGH CAPACITY TRANSPORT OF PASSENGERS AND/OR CARGO

CROSS-REFERENCE TO RELATED APPLICATION

The present application claims priority to Brazilian Patent Application No. BR 10 2018 074144 6, filed Nov. 23, 2018, the content of which is incorporated by reference herein.

INTRODUCTION

The present invention relates to improvement developed in pneumatic propulsion system for transport of passengers and/or cargo, which integration of equipment and arrangements render it high capacity and maximum operational flexibility.

STATE OF THE ART

Patent documents PI 7703372-8, PI 79062555, PI 8301706-2, PI 8503504-1, PI 9502056-0, PI 9814160-0, PI 9912112-3, PI 0805188-7 and PI 0901119-6 disclose a pneumatic transport system which is composed of light vehicles preferably provided with trucks, containing four metallic wheels each, at least one of the axles being connected to a pylon bolted to a propulsion plate, which is responsible for the conversion of the fluid thrust into mechanical work for moving the vehicles over railway rails seated on a special elevated guideway.

Mounted on vertical pillars, the elevated guideway, besides the classic function of sustaining and directing the vehicles, is also featured by its propulsion duct comprising a device intended to provide the physical means for containment and spreading of the air flow generated by stationary power propulsion units. Composed of a heavy duty industrial blower and a set of valves, the power propulsion units are responsible for increasing or reducing pressure in the hollow interior of the beams forming the elevated guideway.

The integration of duct with propulsion plates results in an intrinsic security of the pneumatic propulsion-based transport system since it features as a vehicle anti-derailment and anti-tipping device that remains permanently anchored to the propulsion duct interior.

Document PI 7906255-5 discloses an evolution of the pneumatic transport system, whose power propulsion unit has an admission duct provided with air flow control valve and flow switch for generating pressure or depression in the interior of the propulsion duct of the beam, over which the vehicle moves. The beam duct has air flow control valves for the air coming from the connection ducts and generated by the power propulsion unit and valves for connection with atmosphere.

Document PI 8301706 discloses another evolution of the pneumatic transport system, which power propulsion unit has connection ducts provided with butterfly valves for flow control that do not require a flow switch for generating pressure or depression inside the beam propulsion duct. The propulsion duct has valves for connection with atmosphere.

Document PI 9502056-0 discloses a further evolution of the pneumatic transport system, which power propulsion unit has a single connection duct also provided with butterfly valves for flow control which do not require the flow switch for generating pressure or depression inside the beam propulsion duct. The propulsion duct has pressure relief valves to atmosphere, section isolation valves and secondary propulsion duct that allows the air flow generated by the power propulsion unit to be discharged into the propulsion duct in two distinct positions, resulting in a thrust on the propulsion plate of a vehicle located within the influence zone of the secondary propulsion duct. The zone of the secondary propulsion duct is normally positioned in the central region of the boarding platform of the stations, one being required for each guideway. The extent thereof is at least equivalent to the length of the longest vehicle designed to operate in the specific track. This document neither discloses the technical and constructional characteristics of the secondary propulsion duct nor the connections thereof with the elevated guideway, being it restricted to the presentation of a mere simplified schematic diagram.

Nevertheless, none of the state of the art documents provides a pneumatic transport system for passengers and/or cargo with high capacity, that is, presenting arrangements of equipment for movement and control that enable the vehicles to displace simultaneously on two tracks and/or with at least two vehicles being able to move between two stations of each track at the same time

SOLUTION OF THE INVENTION

The object of the present invention is the improvement in pneumatic propulsion system for high capacity transport of passengers and/or cargo presenting the following technical features:

- Propulsion equipment suitably integrated, elevated guideway forming the propulsion duct, power propulsion units, air flow control valves, section isolation valves, atmospheric valves, pressure relief valves, secondary propulsion ducts, flow direction valves and guideway switch devices disposed on crossovers;
- Elevated power propulsion unit, housed in machine rooms inside the very station located immediately below the passengers boarding and landing platform and, consequently, with air being blown directly on the lateral face of elevated guideway;
- Arrangement of components of pneumatic propulsion and traffic control of vehicles for operation in dual guideways, also enabling the traffic of more than one vehicle between two stations, when thus projected;
- The set of atmospheric valves, section isolation valves, air flow control valves, flow direction valves linked to a distribution of power propulsion units which make this a high capacity system, as well as enable the continuity of the operation even when vehicles are required to switch guideways in case of unavailability of guideway sections, failure of one or more of these pneumatic propulsion components or of the vehicle;
- Arrangement of components of pneumatic propulsion so as to provide flexibility to gradually increase the transport capacity, enabling operation on the same track, from a system which offers low initial transport capacity to one in which maximum transport capacity of the pneumatic propulsion system can be attained with high degree of operational redundancy, without requiring further expensive interventions;
- Propulsion circuit for a complex line in pinched-loop normal operation regime that is, a dual guideway with bidirectional circulation of vehicles and return in the opposite direction in both ends, through shunting terminals each composed of at least a crossover, preferably, two crossovers installed per shunting terminal, by criterion of redundancy and operational flexibility, being one in each end of the station;

Besides the shunting terminals, additional crossovers are strategically included in the stations to allow possible by-pass in the reverse direction in one or more sections or, further, to provide pneumatic interconnection between both guideways, thus enabling the creation of alternative circuits in specific cases Provision of fittings for valve coupling corresponding to the necessary openings in the lower back and sides of the elevated guideway beams for the passage of air, being previously executed at the time of their construction Arrangement in which there is at least a power propulsion unit housed in a central station located between two immediately adjacent stations under its direct influence, which results in a distributed charge loss, reduced by half during the vehicle propulsion, in function of the shortening of the distance to be travelled by the air stream, thus further increasing the energetic yield of the system;

Propulsion arrangement that allows using, with the smallest possible control block, all the power propulsion units both in pressure mode (push) and in suction mode (pull), due to the presence of a section isolation valve upstream and downstream each power propulsion unit, assuring broad redundancy and operational flexibility for the propulsion system; and Propulsion arrangement allowing reversion of the normal travelling direction of the vehicle in the elevated guideway, both in the entirety of the track and in one or more of the sections thereof, through the installation of atmospheric valve upstream and downstream each power propulsion unit, rendering possible the approach of a vehicle in either of the two directions.

ADVANTAGES OF THE INVENTION

The improvement in pneumatic propulsion system for transport of passengers and/or cargo, proposed by the present invention, results in the following advantages in relation to the state of the art:

Engine room located under the passenger station platform providing easy, quick and safe access to it, reduces significantly the overall visual impact of the system and protects equipment against flooding and vandalisms, as well as facilitates acoustic insulation of the noise generated by the rotary machines;

Segment of secondary connection duct parallel to the propulsion duct making the pneumatic transport system of high capacity, designed to reduce the thermodynamic irreversibility of the pneumatic propulsion system from the diminution of the localized charge losses, as well as rendering the installation more compact, allowing the insertion of the power propulsion unit into the limited space available in the technical pavement of the passenger stations;

Arrangement of components of pneumatic propulsion and of traffic control for the vehicles operating in two tracks and with possibility of switching tracks in case of failure of some of these components, unavailability of sections in the guideway and/or vehicle failure, resulting in the highest performance in terms of energy consumption of the system, capital cost, operational cost and level of the service offered;

High flexibility in the installation of tracks, offering from smaller initial transport capacities to high capacities compatible with mass transport systems;

Possibility of progressive increment in the quantity of propulsion equipment, following a pre-established logic still in the operational project phase, accompanying the growth of the passenger demand throughout the useful lifetime of the pneumatic propulsion system reducing initial investment costs;

Propulsion circuit allowing to operate a complex track in regime of normal operation in pinched-loop, that is, a dual guideway with bidirectional circulation of vehicles and return in the opposed direction in both ends with shunting terminals;

Provision of fittings for broadening the transport capacity of the tracks with valve coupling, in types, quantities and localization defined in the project phase;

High degree of redundancy and operational flexibility to the pneumatic propulsion system, which then is able to accommodate possible failures, combined or not, in one or more power propulsion units, guideway valves, crossovers and/or unavailability for traffic in guideway sections between two or more stations, enabling at least a degraded operation mode in the worst conceivable scenario, or even the normal operation, without affecting the overall performance of the transport system, in the less critical cases.

DESCRIPTION OF THE INVENTION

Figure 2:
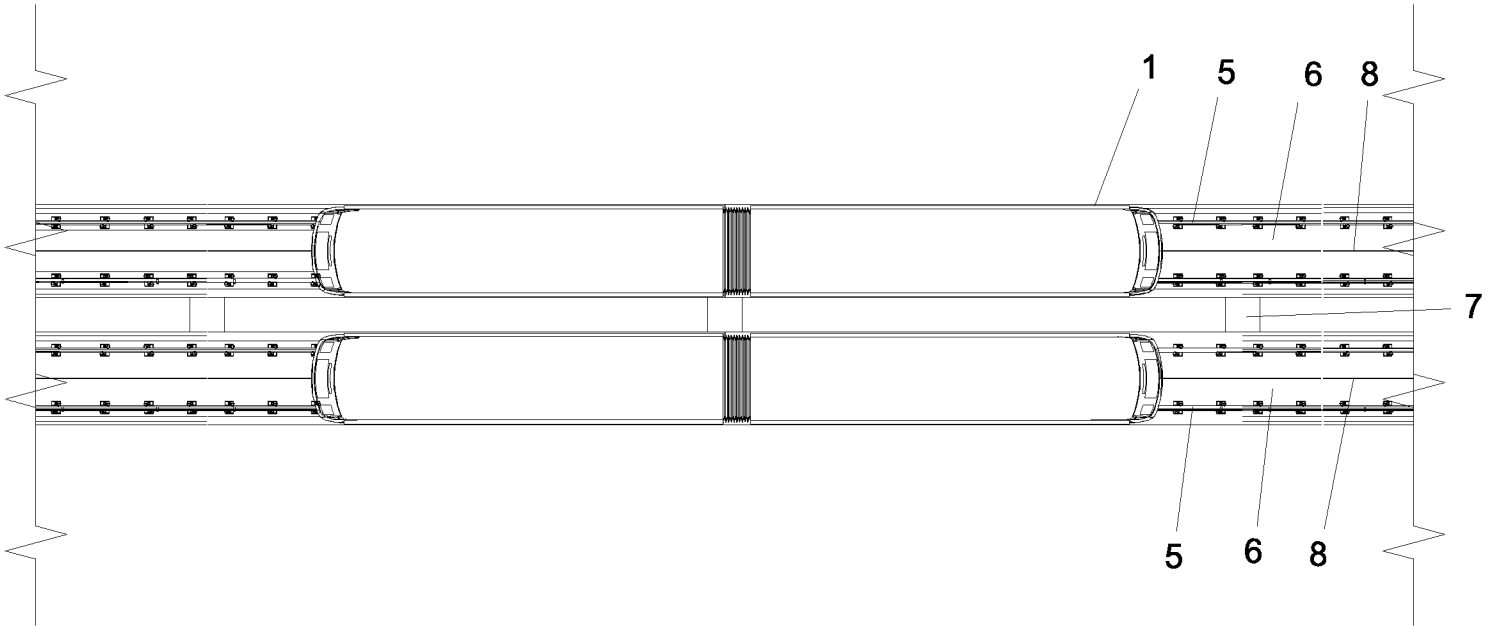
Figure 3:
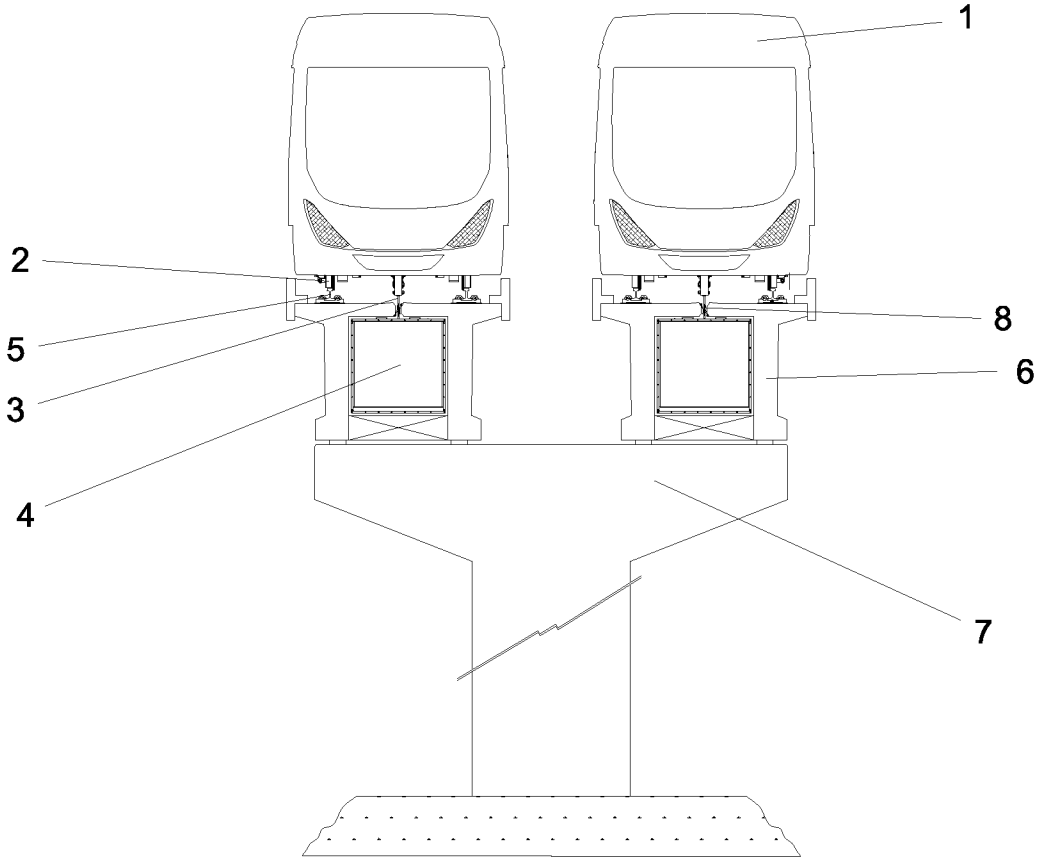
Figure 4:
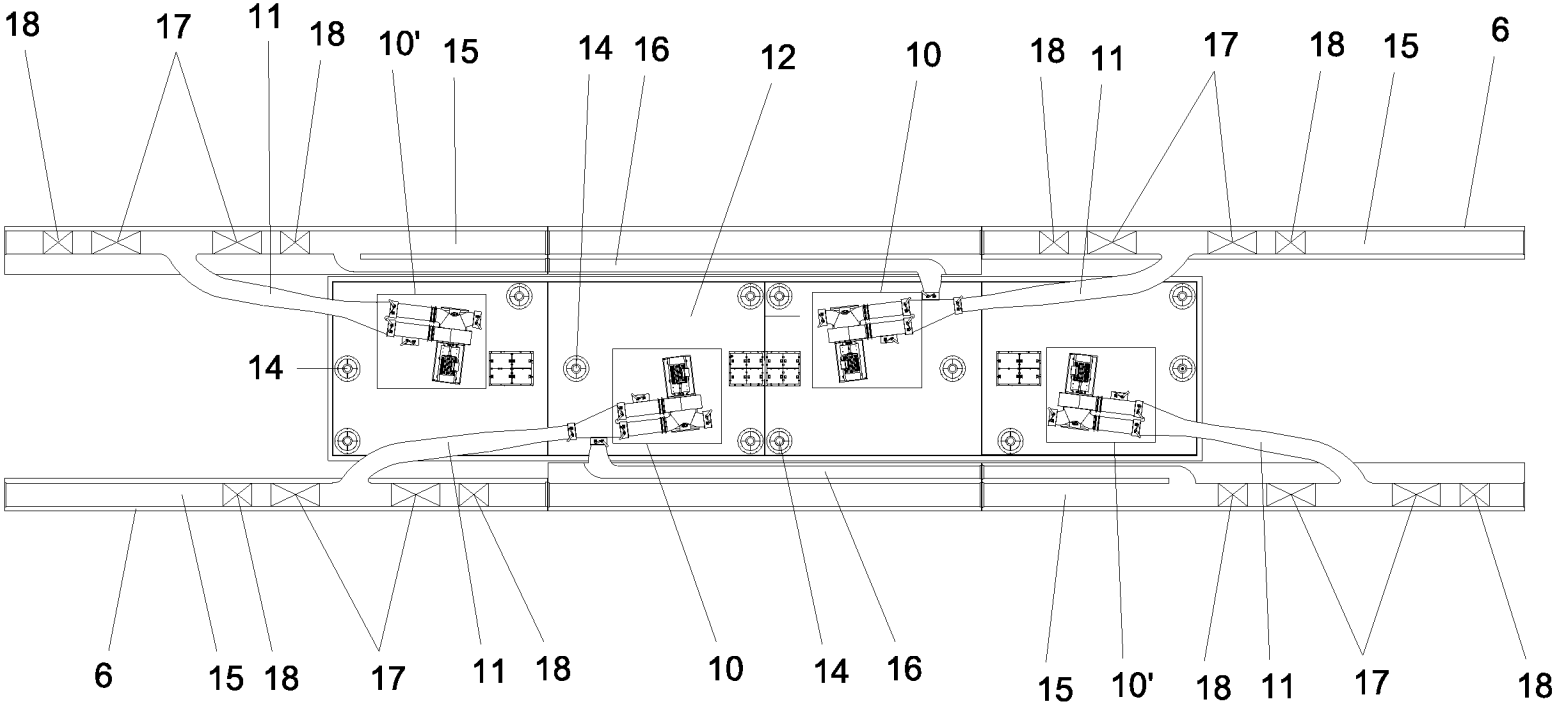
Figure 5:
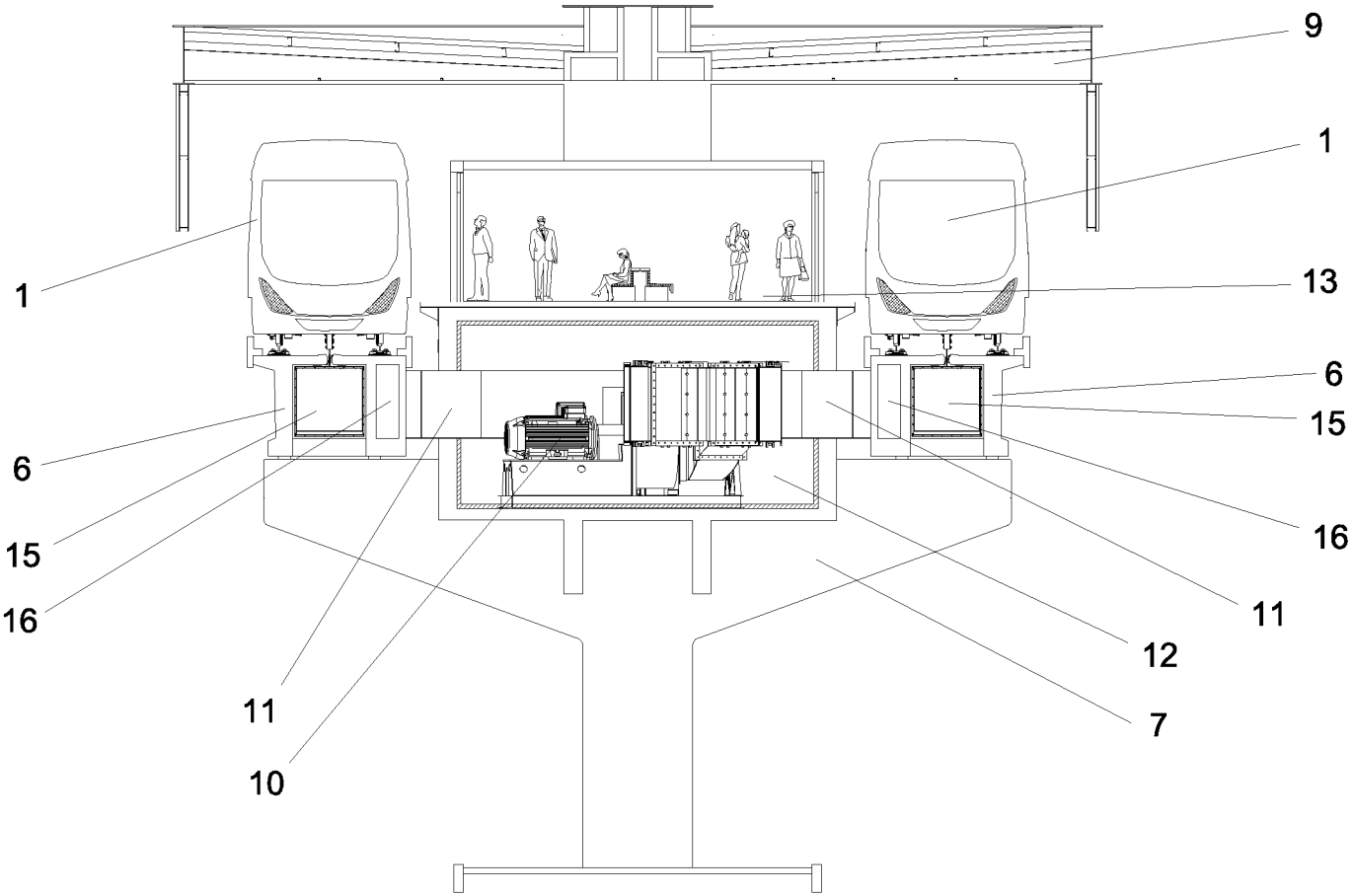
Figure 6:
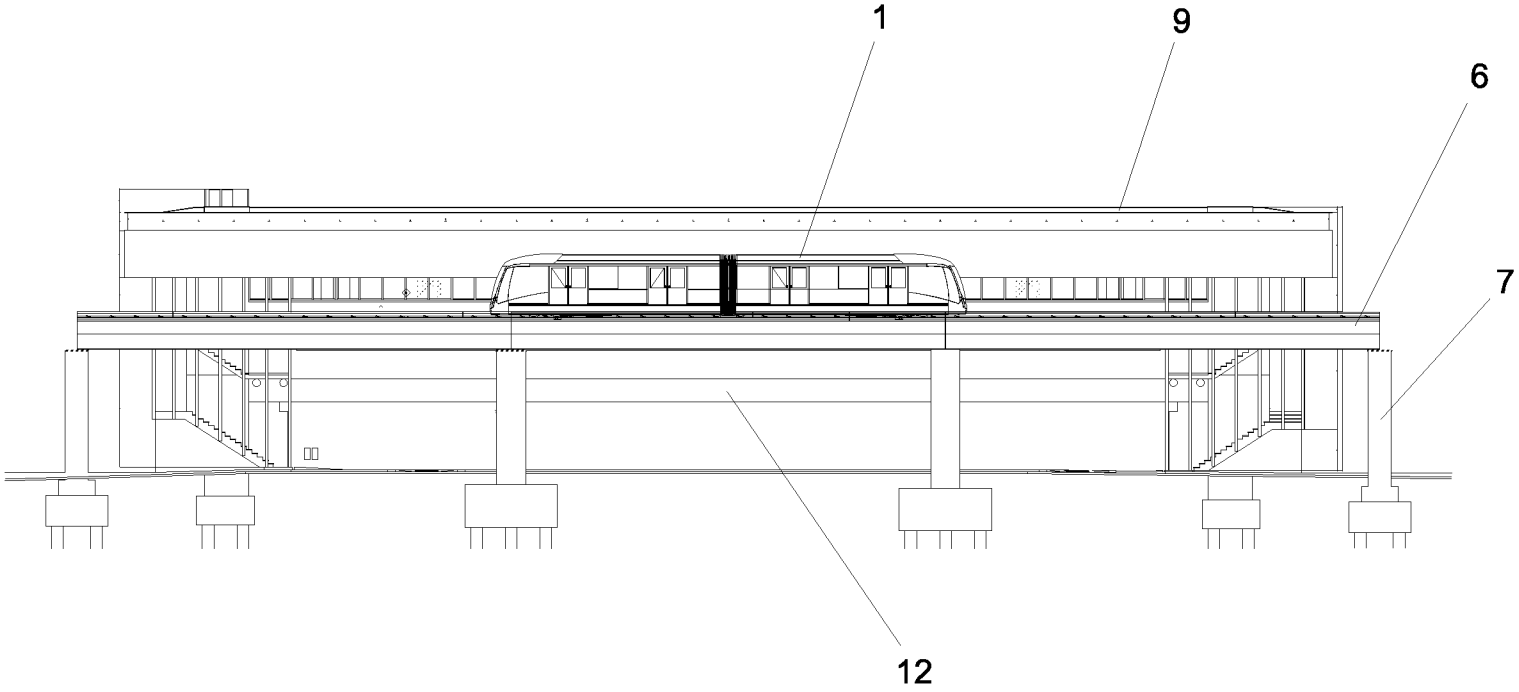
Figure 7:
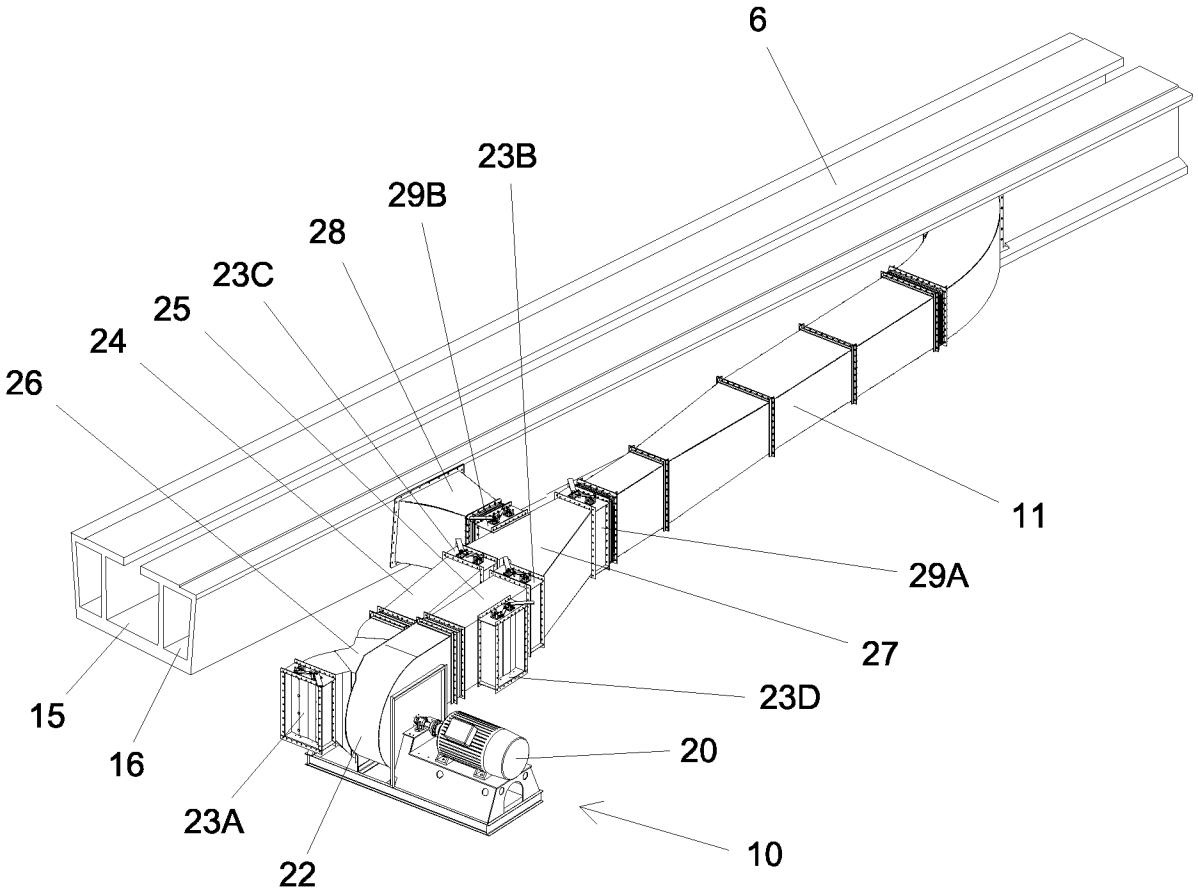
Figure 8:
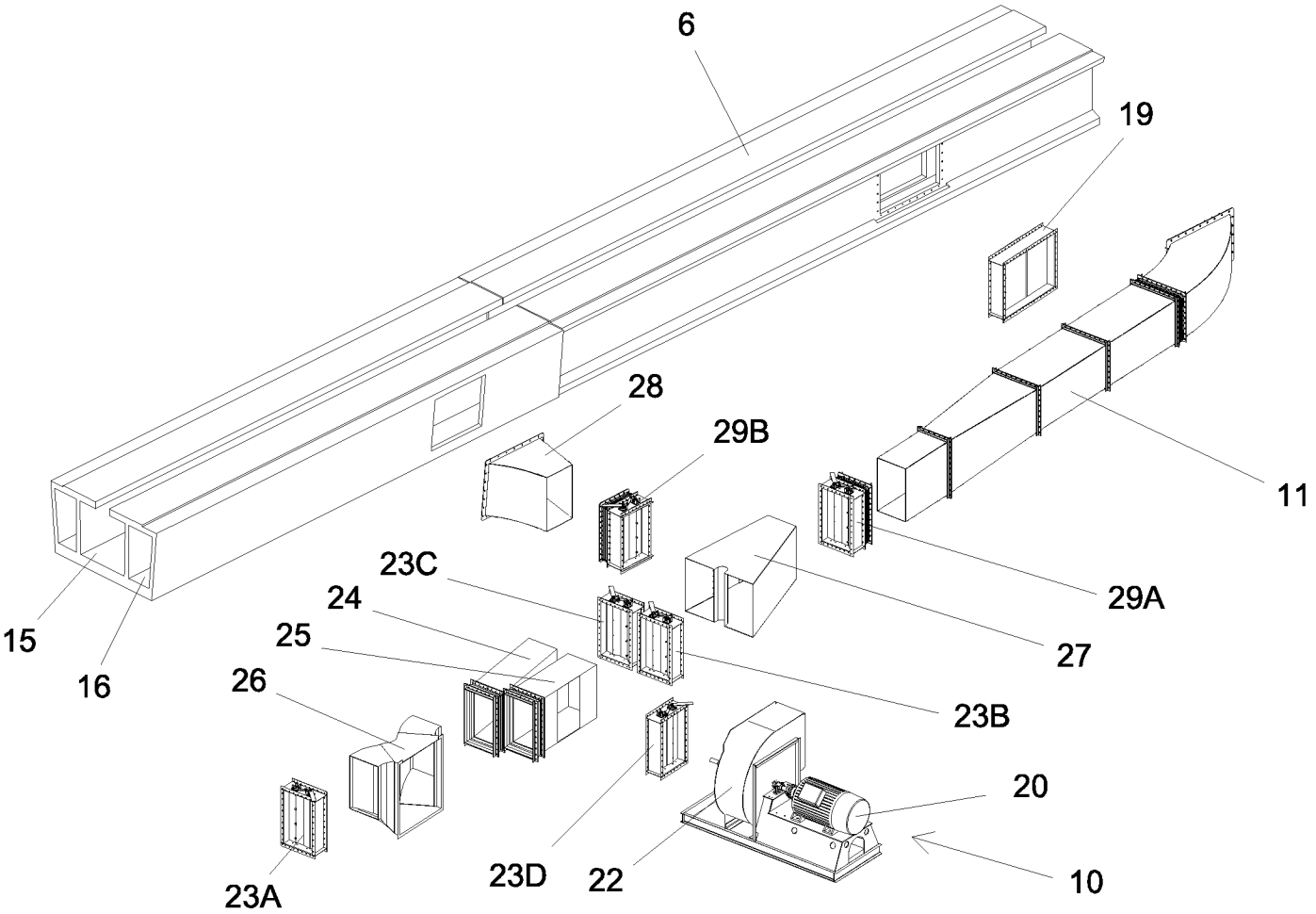
Figure 9:
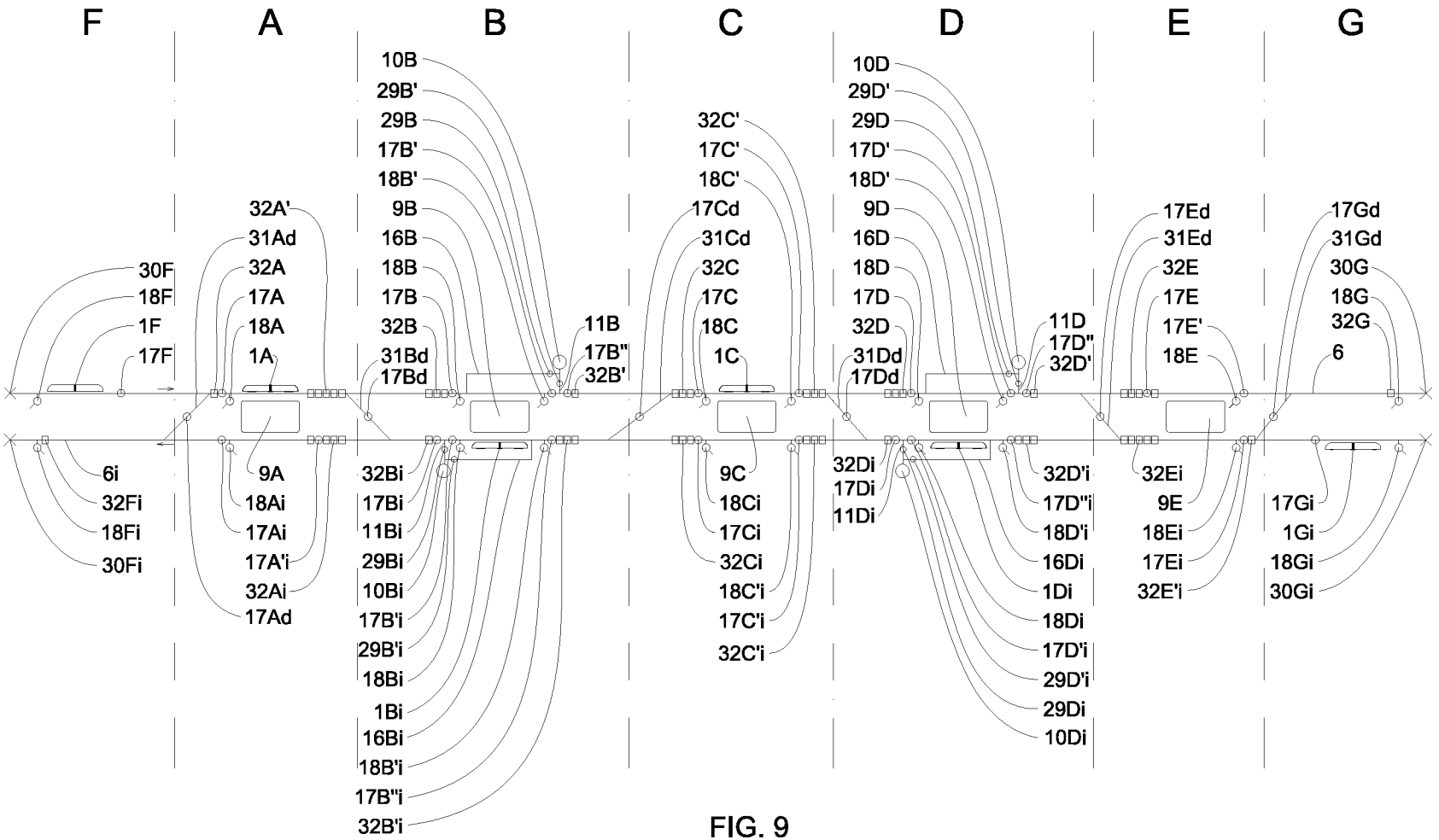
Figure 10:
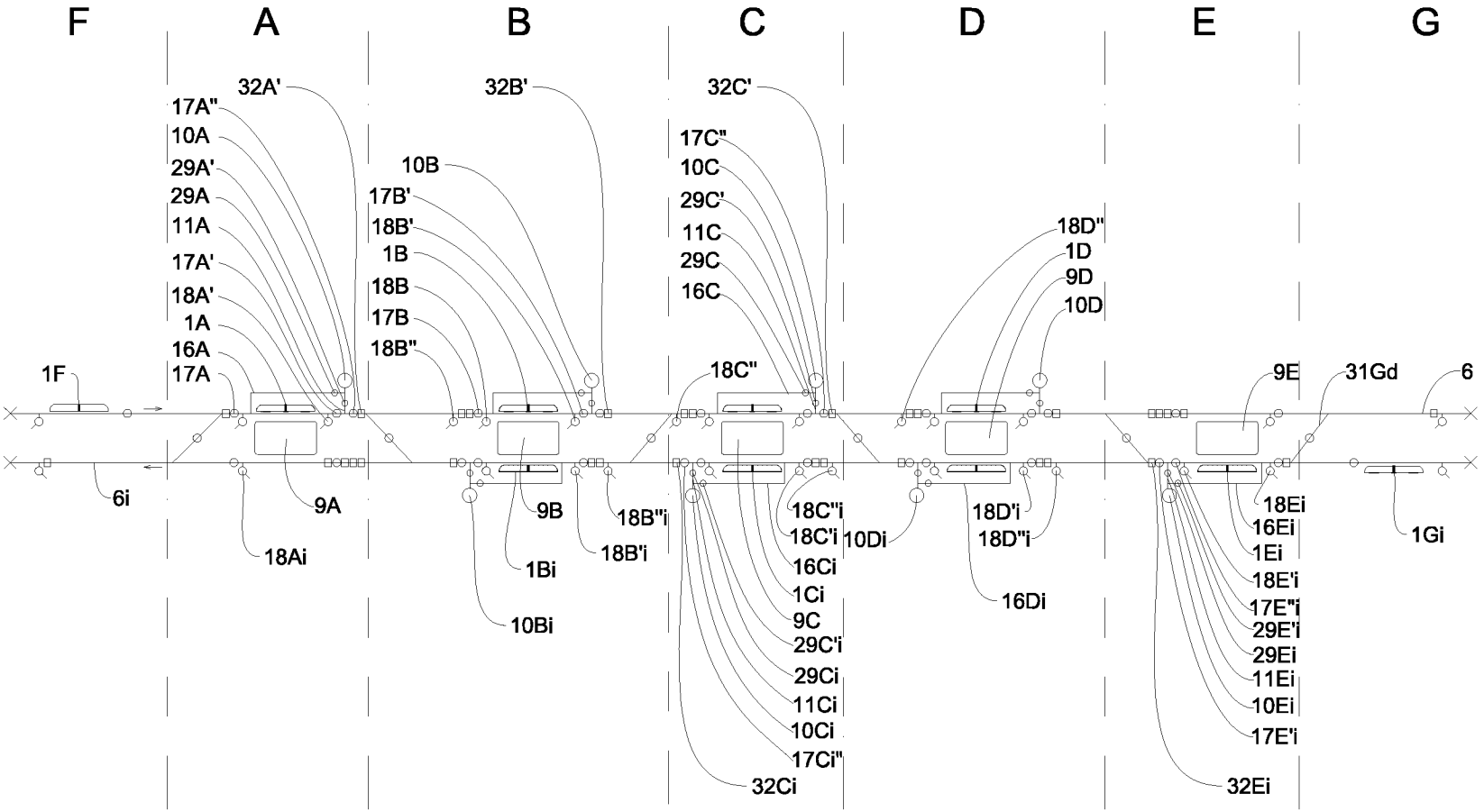
Figure 11:
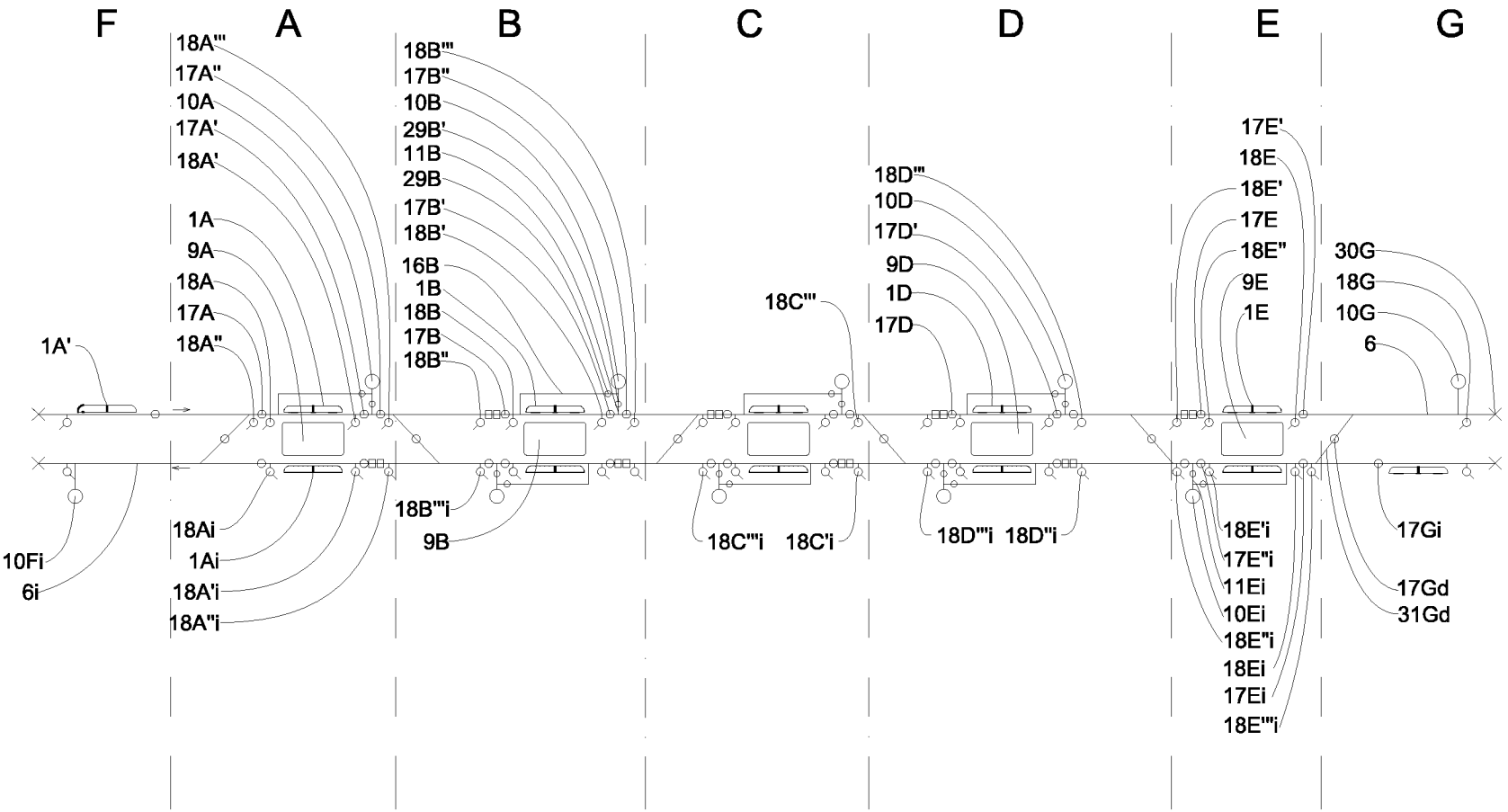
Figure 12:
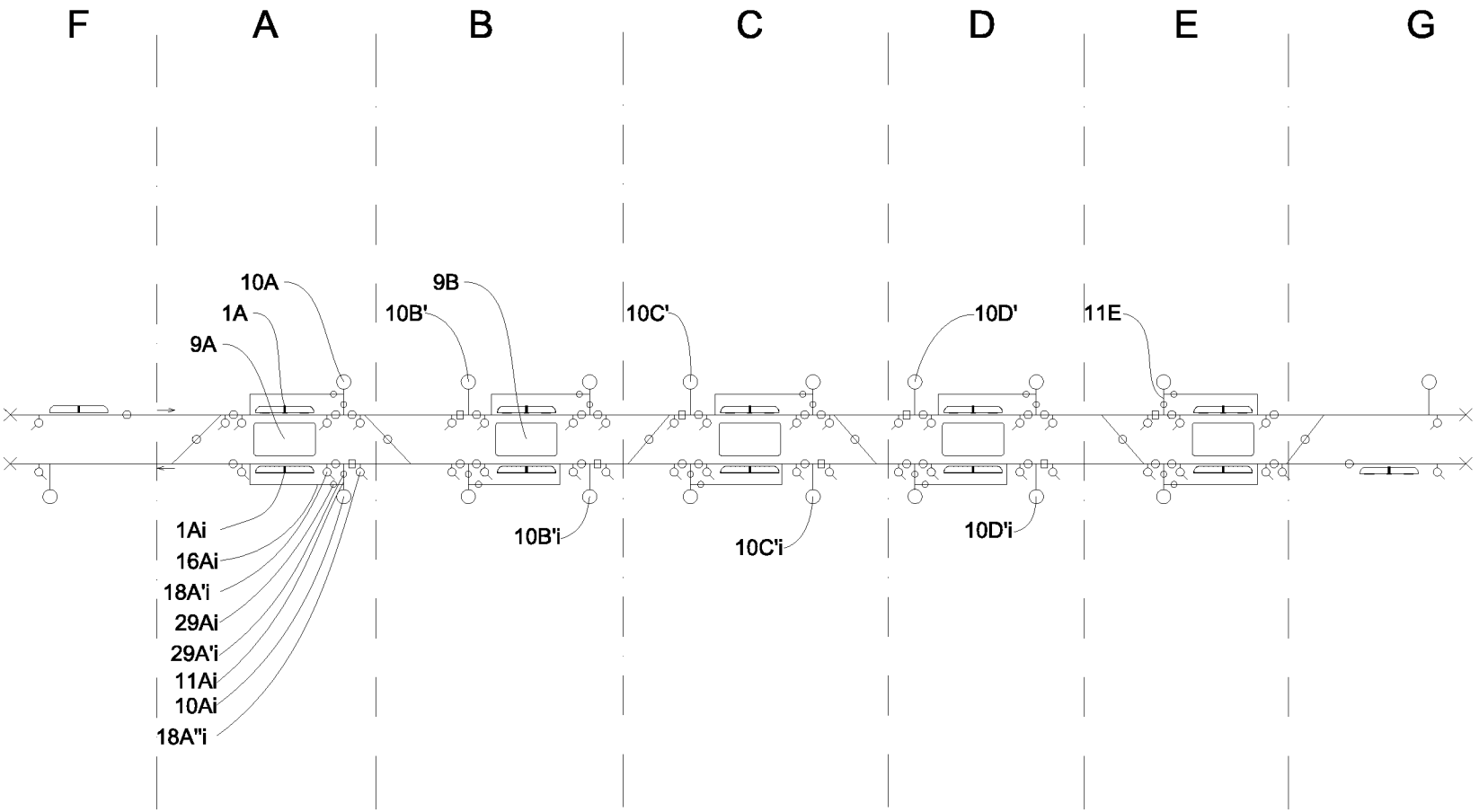
Figure 13:
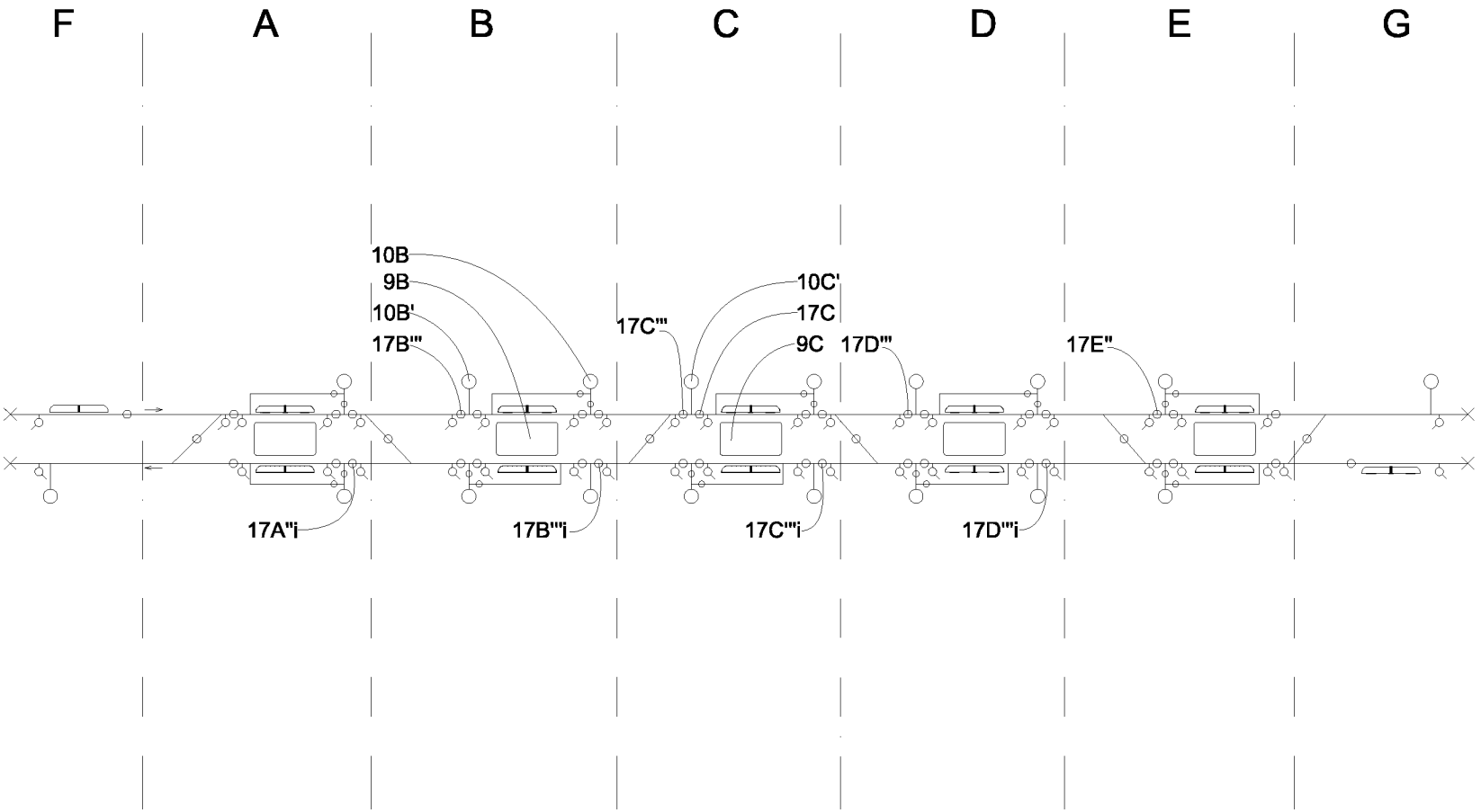
Figure 14:
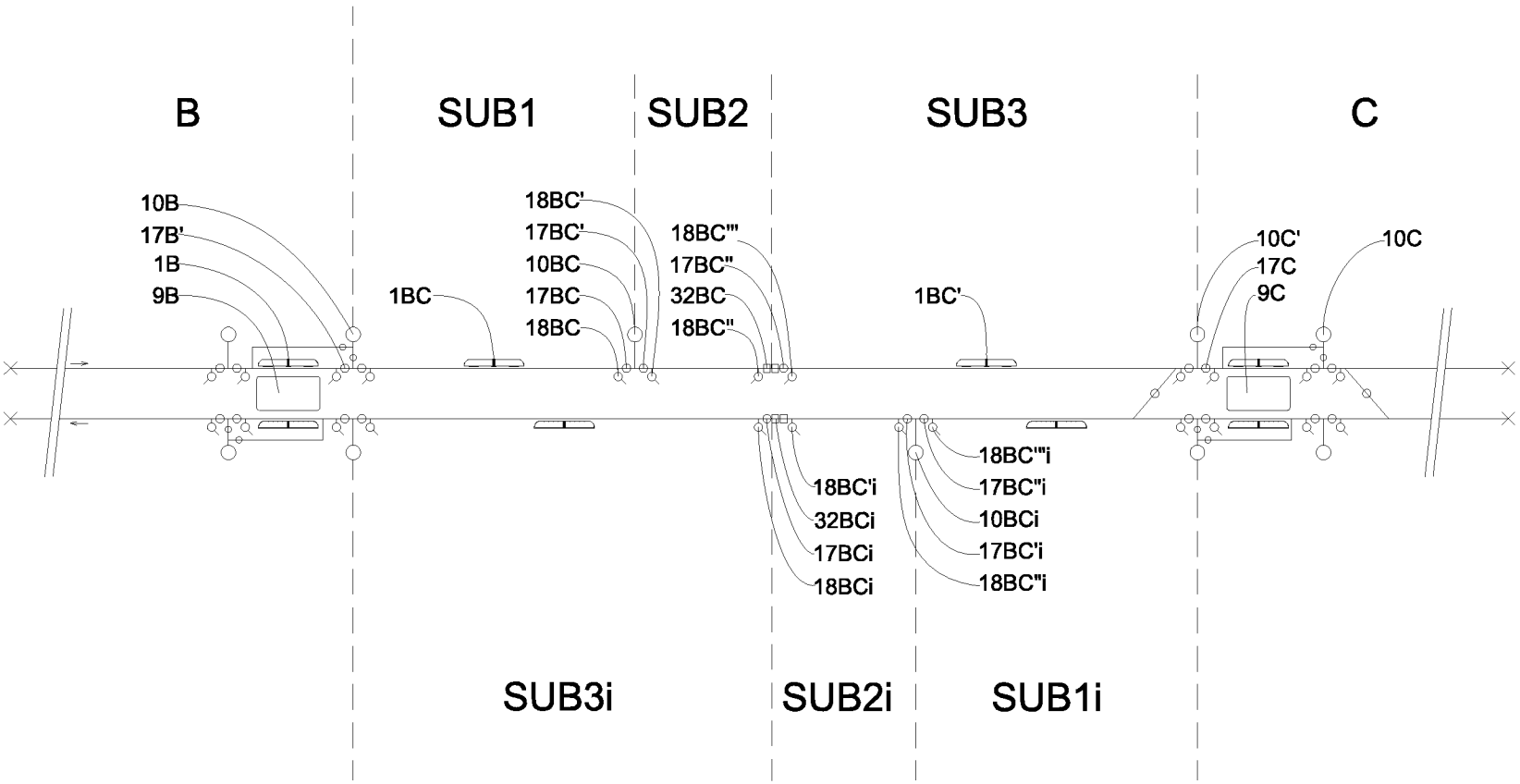
Figure 15:
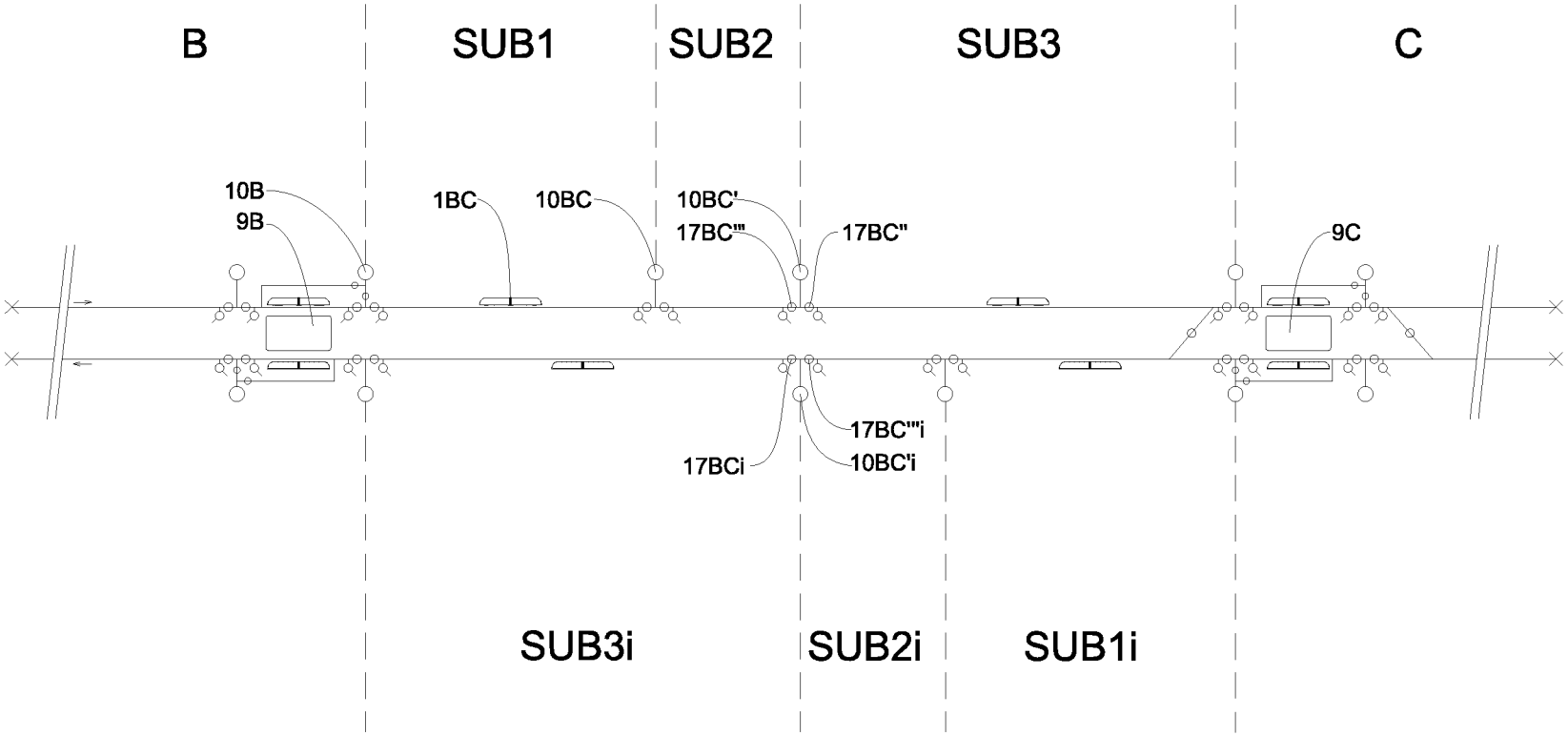

The improvement in high capacity pneumatic propulsion system for transport of passengers and/or cargo of the present invention is now described in detail on the basis of the enclosed figures listed below:

FIG. 1—side view of the vehicle on the elevated guideway;

FIG. 2—top view of the vehicle on the elevated guideway;

FIG. 3—front view of the vehicle on the elevated guideway;

FIG. 4—top view of a passenger station at the level of the technical pavement;

FIG. 5—front view of the passenger station;

FIG. 6—side view of the passenger station;

FIG. 7—perspective view of the power propulsion unit coupled to the guideway;

FIG. 8—exploded perspective of power propulsion unit and of guideway;

FIG. 9—diagram of a first arrangement of the propulsion equipment;

FIG. 10—diagram of a second arrangement of the propulsion equipment;

FIG. 11—diagram of a third arrangement of the propulsion equipment;

FIG. 12—diagram of a fourth arrangement of the propulsion equipment;

FIG. 13—diagram of a fifth arrangement of the propulsion equipment;

FIG. 14—diagram of a sixth arrangement of the propulsion equipment;

FIG. 15—diagram of a seventh arrangement of the propulsion equipment.

FIGS. 1 to 3 illustrate the pneumatic propulsion system which is composed of vehicles (1), provided preferably with two or more trucks, each being composed by four resilient-core metallic wheels (2), with one of axles being connected to a pylon (3) fixed to a propulsion plate (4), which is responsible for the conversion of the fluid thrust of the compressed air stream into mechanical work. The vehicles (1) move on railway rails (5) seated on an elevated guideway (6) supported by pillars (7). At the top center of the elevated guideway superstructure (6) there is a longitudinal slot (8) through which it is allowed the free passage of the pylon (3) of propulsion plate (4) along the schedule.

FIGS. 4 to 6 illustrate a boarding and landing station (9) in the preferred configuration in central island, with power propulsion units (10, 10'), preferably elevated, so that their connection duct (11) joins the lateral face of elevated guideway (6). The power propulsion units (10, 10') are installed in the technical pavement of passenger stations (9) supported on pillars (7), inside an engine room (12), located in the landing place immediately below that of the platform (13) of the boarding station (9). Admission and exhaust of air into the machine room (12) is made through acoustic attenuators (14). The whole of the four connection ducts (11) is responsible for linking with the propulsion duct (15) the four power propulsion units (10, 10'), two of which, so centrally positioned, are also joined each to its respective secondary propulsion duct (16).

The guideway section isolation valves (17) integrate the arrangement of pneumatic propulsion system and are positioned upstream and downstream the connection ducts (11) of the power propulsion units (10, 10') in propulsion ducts (15) and are intended to block air flow in the corresponding section of guideways (6). The atmospheric valves (18) further integrate the arrangement of the pneumatic propulsion system and are positioned alongside the guideway section isolation valves (17) and are intended to take external air in the corresponding section of guideways (6).

The propulsion system of the invention is composed of dual elevated guideway (6) where there are installed two power propulsion units (10) for the cases of operation in which only the propulsion in push or pull mode is required, one dedicated to each elevated guideway, for attaining both traffic directions. In this application of high transport capacity, the push-pull propulsion is mandatorily required for maintaining the same levels of dynamic performance, and it is then necessary to add two more power propulsion units (10') per machine room.

The section isolation valve (17) compartmentalize a propulsion circuit in relation to another one adjacent by the physical interruption of propulsion duct (15) and consequent blocking of air passage in the interior of guideways (6). By having a driving mechanism mounted at the lower back of the elevated guideway (6), the section isolation valve (17) takes only two positions: fully open or fully shut, and its fail-safe system is featured by locking in the last known position. In the open position, propulsion duct (15) is cleared allowing free flowing of air and the passage of propulsion plates (4) of the vehicle (1). The crossing thereof over an open section isolation valve (17) allows the ingress in the next section or propulsion circuit. Typically, the section isolation valves (17) separate sections of guideway (6), defining independent propulsion circuits and their respective exclusive control blocks for each vehicle.

The atmospheric valve (18) opens or shuts communication between the propulsion duct (15) and the atmosphere, and it may operate open, shut or taking intermediate positions, as a way for controlling the pneumatic braking of the vehicles. Its fail-safe position is always shut, and to that end, it must be equipped with a fail-safe device. Mounted on the lower back of elevated guideway (6), the atmospheric valve (18) has functions complementary to those of power propulsion unit (10) when it establishes a propulsion circuit suited to the traction of vehicle (1). Atmospheric valve (18) has the following primary and secondary functions:

a) Allowing or blocking passage of air from/to atmosphere, when open or shut, respectively;

b) Acting as redundancy for an adjacent power propulsion unit (10, 10') and, when the generation of air flow by this is not necessary, but linking with the atmosphere is required for continuity of movement of vehicle;

c) Reducing charge loss by means of increasing the area of passage of air in strategical points of an excessively long propulsion circuit by the reduction of its length;

d) Controlling the pneumatic braking of vehicles (service brake) through multiple cycles of opening and shutting or of proportional shut position;

e) Acting as emergency brake of vehicles through its full shutting; and f) Creating or modifying propulsion circuits along with the section isolation valves (17) and power propulsion units (10, 10'), as necessary for vehicle (1) control within these circuits.

The induced localized charge loss, generating the back-pressure inside the propulsion duct (15) for controlling the pneumatic braking of the vehicle (1) is a product of controlled actuation of atmospheric valve (18). For purposes of regulation, the blades of atmospheric valve (18) can take intermediate positions between the fully open state and the fully shut state, or only switching directly between both extremes.

The gains of this solution are many, including:

i) introduction of an effective form of fine metering of the pneumatic brake, which reduces to a minimum the overshoot of the effective deceleration rate in relation to the programmed one;

ii) reduction of over acceleration (acceleration variation rate) of vehicles (1), resulting in an increase of comfort of the passengers on board; and iii) reduction of wear of mechanical components of the friction brake, since this latter is now intentionally subtilized due to the increase in pneumatic brake efficiency.

During pneumatic braking, under extraordinary circumstances wherein the pressures on the propulsion duct (15) may go beyond those normal work pressures especially upon the accidental absence of the pressure transducer signal, or in case of spurious values reading, a mechanical pressure relief valve (19) will be operated automatically for regulating it. Mounting of pressure relief valve (19), illustrated in FIG. 8, can be made in the upper slab of the elevated guideway (6) or in any face of connection duct (11) to propulsion duct (15).

Secondary propulsion duct (16), constructed in parallel with propulsion duct (15) and integrated with its respective flow direction valve (29), illustrated in FIG. 8, allows the air flow generated by power propulsion unit (10) to be discharged into the propulsion duct (15) in two distinct positions, establishing a push or pull type thrust applied to the propulsion plate (4) of a vehicle (1) located within the zone of secondary propulsion duct (16). The zone of secondary propulsion duct (16) is normally positioned in the central region of boarding platform (13) of stations (9), one being necessary for each guideway (6). The extension thereof is delimited by the distance measured in the guideway (6) between the opening for connection of secondary propulsion duct (16) to the propulsion duct (15) and the connection of connection duct (11) to propulsion duct (15). This distance is at least equivalent to the longer vehicle (1) length designed to operate in a specific application.

FIGS. 7 and 8 show details of one of the power propulsion units (10) that generate air flow in the interior of elevated guideway (6) and which are composed of a variable speed motor drive (20) linked through elastic coupling to a heavy duty industrial blower (22) of the centrifugal or axial type with high energetic yield and with characteristic curve suited to meet the particular requirements of the pneumatic propulsion system.

Power propulsion units (10, 10') can be conveniently serially associated for summing up pressure and in parallel for summing up flow rate in two or more stages, or further, in a combination thereof. The gauge work pressures can typically reach up to 20 kPa, above or below atmospheric pressure.

The vehicles of the pneumatic propulsion system operate according to the regimes of "pressure or push", "suction or pull" and "push-pull" propulsion, respectively, positive pressure, negative pressure and positive/negative pressure. The positive pressure is applied to the propulsion plate upstream simultaneously to the application of negative pressure downstream, resulting in doubled net thrust during acceleration phase of the vehicle, without any sacrifice of the mechanical components or the elevated guideway structure, since the force exerted remains unchanged.

The condition of gauge pressure above or below atmospheric pressure is determined by positioning four air flow control valves (23) mounted in the interconnection ducts of power propulsion units (10, 10'). Air flow control valves (23) are preferably of the venetian blind type with parallel or opposed blades and have central function in the pneumatic propulsion system since along with an atmospheric valve (18) of propulsion duct (155), they initiate and keep pressurization inside the elevated guideway (6), which can be ceased in a manner independent from said atmospheric valve (18).

Air flow control valves are of four types: pressure control valve (23A), pressure security control valve (23B), suction control valve (23C) and suction security control valve (23D). The pressure control valve (23A) and suction control valve (23C) are responsible for admission of air in the inlet cone of blower (22) of power propulsion unit (10) and can have proportional or multistage opening for metering air flow rate, or only assume the two extreme positions of end of stroke. The security control valves (23B and 23D) are those responsible for the air discharge at the blower (22) outlet of power propulsion unit (10) and take only one of the two possible extreme positions of end of stroke. Considering that the safe position thereof is always the shut position, they must be equipped with fail-safe device. When all air flow control valves (23) are placed in the shut position, blower (22) runs idle in the stand-by mode.

The combination of air flow control valves (23A to 23D) can be further as such to allow connection of propulsion duct (155) to atmosphere, emulating the function of an atmospheric valve (18), when blower (22) is off or in stand-by-mode. To that end it is necessary that pressure control valve (23A) and suction control valve (23C) or pressure security control valve (23B) and suction security control valve (23D) are commanded as a whole. In the acceleration and cruise phases, control of preprogrammed speeds of vehicles (1) is made through power propulsion units (10, 10') with the use of the strategies of varying the angular speed of rotors of blowers (22), of varying the opening angle of blades of air flow control valves (23A to 23D) or a combination of both.

Pneumatic propulsion is utilized to both accelerate the vehicles (1), and regulate the cruise speed and, just so importantly, as a pneumatic brake of the transport system and its main mode of deceleration. This braking is caused by the compression and/or expansion work of air confined inside the propulsion duct (15), downstream and/or upstream the propulsion plate (4) of the vehicle, respectively. Braking is initiated by the concomitant shutting of both air flow control valves (23) of power propulsion unit (10) and atmospheric valves (18) of propulsion duct (15). The external pneumatic braking of the vehicle (1) is supplemented by the traditional onboard friction brake, guideway caliper and brake disc, for the purposes of stopping precision, especially for positioning its doors in full alignment with the automatic doors of the boarding and landing platform (13) of the passenger stations (9).

The absence of onboard motors in vehicles (1) and the consequent use of external propulsion remotely generated from the power propulsion units (10, 10') allows for a continuity of the transport system operation even in the accidental unavailability of one or more of these groups, not affecting directly any vehicle (1) in special.

Two identical segments form part of the set of interconnection ducts, the first segment (24) being installed in the admission to the air inlet casing (26) and the second segment (25) being mounted in the discharge mouth of blower (22), both connected to a plenum (27) which makes the convergence of the air flow towards the connection duct (11), designed for flow stabilization to the propulsion duct (15).

Plenum (27) has four openings for air passage, where there are mounted the flow control valves: suction valve (23C) connected to air admission, security valve (23B) connected at the blower (22) discharge and the flow direction valves (29A and 29B) to the interior of connection duct (11) and to the secondary propulsion duct (16), respectively. After the flow direction valve (29B) there is still a secondary duct segment (28) for interconnection to secondary propulsion duct (16).

In connection with FIG. 4, it is found that the flow direction valves (29A and 29B) are mounted in the plenum-type interconnection duct (27) of power propulsion unit (10) e, when integrated with its respective secondary propulsion duct (16), allows the passage of a vehicle (1) over the discharge of the connection duct (11) of power propulsion unit (10) towards the propulsion duct (15), without interruption of the propulsion thrust or generation of undesirable backpressure and, consequently, negative work.

The flow direction valve (29A or 29B) and the secondary propulsion duct (16) conveniently deviate the air flow to one of the propulsion plates (4) of vehicle (1), upstream or downstream, so as to always keep an effective thrust on vehicle (1) and thus move it in one or another direction under circumstances in which propulsion plate (4) will be passing over the discharge point of power propulsion unit (10) or further when the volume of the chamber formed between the two propulsion plates (4) of vehicle (1) is in the discharge point of said power propulsion unit (10).

Two flow direction valve units are employed: unit A (29A) and unit B (29B), working normally as two valves in synchronism, alternating in the fully open and fully shut positions, their only possible positions. Since the fail-safe position of both units (29A and 29B) is always the shut position, these should be preferably equipped with fail-safe device. Unit-A flow direction valve (29A) is installed between the power propulsion unit (10) and the propulsion duct (15) providing direct connection of the air flow between them. The Unit-B flow direction valve (29B) is installed between the power propulsion unit (10) and the secondary propulsion duct (16) in order to deviate the air flow generated by power propulsion unit (10) through the secondary propulsion duct segment (28), towards a distinct point of connection with elevated guideway (6).

In its typical application, when localized near the passenger stations (9), flow direction valve (29), along with its respective power propulsion unit (10) and secondary propulsion duct (16), allows the adjustment of the configuration of the propulsion circuit for the following situations:

a) Arrival, stop and departure of a vehicle (1) within a zone of secondary propulsion duct (16);

b) Passage of a vehicle (1) through the discharge of connection duct (11) of a power propulsion unit (10) which is propelling it, with or without stopping in the zone of secondary propulsion duct (16);

c) Ingress of vehicle (1) in the adjacent propulsion circuit or control block from a station-control block;

d) Movement of a vehicle (1) located within a zone of secondary propulsion duct (16) in one or another direction in relation to the respective power propulsion unit (10); and e) Shunting or repositioning a vehicle (1) in relation to the station platform (13) whenever the vehicle stops out of the project position, moving the vehicle in one or another direction within the zone of secondary propulsion duct (16).

If necessary, the secondary propulsion duct (16) can be used for covering long distances, to beyond the domain of the passenger stations, constituting a means for conducting the air from a remote power propulsion unit (10) up to a determined point in elevated guideway (6) in which the discharge of air is required, but due to some physical impossibility, a power propulsion unit cannot be installed there.

The flow direction valve (29) has the following configurations and respective effects on the propulsion system, according to the position of its units:

(a) Both units A (29A) and B (29B) shut: this configuration allows the isolation of the power propulsion unit (10) from the propulsion duct (15). In this configuration, the flow direction valve (29) allows that maintenance of the power propulsion unit (10) is carried out during system operation by reason of the shutting of propulsion duct (15) to the atmosphere, regardless of the position of their air flow control valves (23). Additionally, this configuration results in shutting the propulsion duct (15) to atmosphere in the region of power propulsion unit (10), increasing the security of the system by the addition of redundancy to the emergency pneumatic brake.

(b) Unit A (29A) open and Unit B (29B) shut: this configuration directs the air flow towards connection duct (11) up to the propulsion duct (15).

(c) Unit A (29A) shut and Unit B (29B) open: this configuration directs the air flow towards the secondary propulsion duct (16) through the secondary duct segment (28).

(d) Both units A (29A) and B (29B) open: this configuration occurs only during the switching of the position of flow direction valves units (29), from the open position to the shut position, or vice-versa, preventing them from being simultaneously shut and consequently can they temporarily interrupt air flow provided by power propulsion unit (10) to propulsion duct (15). This configuration of units A and B allows the continuity of the propulsion thrust by maintaining the open position of the unit which will shut at the moment another unit intended to open is fully open.

FIGS. 9 to 15 illustrate arrangements of equipment of the pneumatic transport system of the invention that make it of high capacity. At the end of each elevated guideway (6) it is installed a duct end plug (30), consisting of a metallic bulkhead screwed inside the propulsion duct (15), emulating a section isolation valve permanently shut.

As in any conventional subway system, crossovers (31) are necessary to allow operational flexibility and provision of high transport capacity. Crossovers (31) are composed of a pair of guideway switch devices connecting two parallel elevated guideways (6) in the detour region allowing the vehicle (1) to freely cross between them. Crossover (31) is composed of four beams integral with each other, two of them belonging to the detour and the other two belonging to the adjacent straight lines. Each crossover (31) contains at least a section isolation valve (17) with the function of preventing that there is cross air flow between the opposed direction elevated guideways (6), when both crossovers (31) are selected to the tangent direction.

Referring also to FIG. 4, vehicle (1) is pulled (suction or pull mode) from the previous station (9) to the central station (9) by the action of power propulsion unit (10) located therein. In sequence, vehicle (1) is pushed (pressure or push mode) from the central station (9), by the action of the same power propulsion unit (10), towards the next station (9), where it is delivered to the next power propulsion unit (10) and so consecutively.

At a distance very close to the discharge point of connection duct (11) of power propulsion unit (10) in propulsion duct (15), there are equipped therein two section isolation valves (17), one upstream and the another downstream, and this latter being introduced for the purpose of activating propulsion in the suction mode. The pair of section isolation valves (17) always take the open and the shut positions in an alternate manner, they cannot be both simultaneously shut or both simultaneously open during system operation.

Each guideway (6) has a preprogrammed running direction, but it is possible the reversion thereof in the whole track or in one or more sections, especially for the degraded operation in partial single guideway. To that end, section isolation valves (17) of the propulsion arrangement, with exception of those located in crossovers (31), are accompanied by two atmospheric valves (18), one upstream and another downstream, making the approach of a vehicle (1) possible in either direction, normal or reverse.

FIG. 9 shows a simpler arrangement of pneumatic propulsion for pinched-loop operation between five passenger stations (9A, 9B, 9C, 9D and 9E), with British left-hand traffic direction, that is, west-east displacement in guideway (6) and east-west in guideway (6*i*). In total there are four vehicles in operation (1A, 1Bi, 10 and 1Di) and two backup vehicles parked (1F and 1Gi), propelled by four power propulsion units (10B, 10D, 10Bi and 10Di) in pressure and suction mode, alternately.

Both guideways (6 and 6*i*) receive duct end plugs (30F, 30G, 30Fi and 30Gi) performing the function of section isolation valves permanently shut. The track has six crossovers, (31Ad, 31Bd, 310*d*, 31Dd, 31Ed and 31Gd), of which two (31Ad and 31Gd) are normally involved in return shunt, while the remaining are reserved for the degraded operation modes. The crossovers equip the region of stations (9A, 9C and 9E).

Guideways (6 and 6*i*) present openings for fittings (32A to 32Fi), previously prepared at the time of their manufacture, which are sealed with metal plugs until the future coupling of new propulsion equipment, being then gradually replaced with valves (17 and 18) and power propulsion units (10), as the propulsion arrangement becomes more complete. After receiving all the projected equipment, they turn into the arrangements represented in FIGS. 13 and 15.

In normal operation regime, vehicle (1A) departs from station (9A) towards station (9B) only after the vehicle (10) parks in station (9C) and section isolation valves (17A and 17B") are in shut and locked position, delimiting the propulsion circuit in question. Atmospheric valve (18A) is commanded to the open position, while the section isolation valves (17B and 17B') are maintained open and atmospheric valves (18B and 18B') are maintained shut. In the power propulsion unit (10B) they are commanded to open the flow direction valve (29B') and the air flow control valves (230 and 23D), while the flow direction valve (29B) and the air flow control valves (23A and 23B) are maintained shut, activating the suction mode through the duct (11B).

At the same time of the departure of vehicle (1A), the vehicle (10) just ahead, in turn, departs from station (9C) towards station (9D) by the action of power propulsion unit (10D) in suction mode by connection duct (11D), moving along the propulsion circuit delimited by section isolation valves (17C and 17D") in shut and locked position. Before the beginning of movement, atmospheric valve (18C) and section isolation valves (17C', 17D and 17D') are commanded to open, while atmospheric valve (18C') is commanded to shut. Atmospheric valves (18D and 18D') remain shut.

When vehicle (1A) is approaching station (9B) and entering the deceleration phase, atmospheric valve (18B') automatically begins, solely or in combination with atmospheric valve (18A), the regulation of the pneumatic braking process, according to preset performance parameters. Air flow control valves (23A and 23C or 23B and 23D) of power propulsion unit (10B) can, alternatively, with the same final result, be used in pairs with the purpose of emulating the effect of the atmospheric valve (18B'), replacing the latter and having the advantage of discharging the air flow into the acoustically insulated machine room.

Since vehicle (1A) is stopped at station (9B), the section isolation valve (17B) is immediately commanded to shut and lock. Before leaving towards the next station (90), vehicle (10) is supposed to have arrived at station (9D), while section isolation valves (17B", 17C) and atmospheric valve (18C') are commanded to open and atmospheric valve (18C) and section isolation valve (17C') are commanded to shut. The section isolation valve (17B') remains open and atmospheric valves (18B and 18B') remain shut.

Power propulsion unit (10B) is activated in the pressure mode by opening the air flow control valves (23A and 23B), while the air flow control valves (230 and 23D) are maintained shut. Air flow is deviated from the secondary propulsion duct (16B), by opening the flow direction valve (29B) and by maintaining flow direction valve shut (29B').

Once the propulsion plate upstream the vehicle (1A) has safely passed the position of section isolation valve (17B'), flow direction valve (29B') is commanded to open, also clearing air passage through connection duct (11B). Soon after the control system confirms the successful opening of flow direction valve (29B'), the flow direction valve (29B) is commanded to shut, ceasing the air flow in secondary duct (16B), providing exclusive passage through connection duct (11B), completing the propulsion transfer from secondary duct to connection duct without causing any interruption of air flow in propulsion duct (15) and, therefore, without affecting normal movement of vehicle (1A). Following this, section isolation valve (17B') is commanded to shut and lock, shortening the original propulsion circuit, and remaining in this situation until arrival of vehicle (1A) at station (9C). In case of any unavailability of flow direction valve (29B'), secondary propulsion duct (16B) can exceptionally propel vehicle throughout the section until its destination.

Due to the intentional simplifications in the project of the propulsion arrangement imposed in the scenario of FIG. 9, on account of the low initial demand and, despite the clearing of the zone of secondary propulsion duct (16B) of station (9B) upon shutting section isolation valve (17B'), even so there is no possibility of the vehicle immediately behind (1Bi) entering there, due to the absence of power propulsion unit at station (9A), which in this step corresponds to one of fittings (32A') for future expansion contemplated in the next scenarios.

By the same sequential reasoning, vehicle (1A) continues its movement up to the end of guideway (6). When this vehicle reaches station (9E), the shunting process to return in the inverse direction in the opposed guideway (6*i*) can begin. To that end, section isolation valves (17E') and atmospheric valve (18G) are commanded to open, while atmospheric valve (18E) is commanded to close. Section isolation valves (17D" and 17E) are maintained open, while section isolation valves (17D' and 17Gd) are maintained shut. Crossover (31Gd) is maintained in the normal position (tangent).

The movement begins when power propulsion unit (10D) enters pressure regime by blowing air through connection duct (11D). Vehicle (1A) stops its movement when it has safely passed the needles of the guideway switching apparatus, represented by the intersecting point of crossover (31Gd) and guideway (6). Subsequently, section isolation valves (17Gd, 17Ei, 17D"i and 17D'i) are commanded to open, while section isolation valves (17E' and 17Di) are commanded to shut. Atmospheric valve (18G) remains open, while section isolation valve (17Gi) and atmospheric valves (18Ei, 18D'i and 18Di) remain shut. Crossover (31Gd) is commanded to the reverse position (curve). Power propulsion unit (10Di), with flow direction valve (29Di) open and flow direction valve (29D'i) shut, begins the suction regime pulling the vehicle to guideway (6*i*) up to station (9E).

With growing increase in demand, stations that are not originally equipped with power propulsion units, now gradually become so, employing to that end the provisions left on their technical pavements during building. Under normal operation circumstances, one of the results of this measure is making the propulsion regime exclusively in pressure or in suction.

In FIG. 10 one of the lateral plugs of the fittings for valve coupling of units (32A', 32C', 32Ei and 32Ci) are removed for allowing junction of connection ducts (11A, 11C, 11Ei and 11Ci) with the propulsion duct of the respective power propulsion units (10A, 10C, 10Ei and 10Ci) newly added. Thus, all the stations now have two power propulsion units, with exception of terminal stations (9A and 9E), that receive only one unit each. This arrangement allows to double the number of vehicles, incorporating vehicles (1B, 1D, 1Ei and 1Ci) and to operate them in pressure mode, exclusively, during all normal situations.

Besides the introduction of the valves accompanying the new power propulsion units, atmospheric valves (18B", 18C", 18D", 18D"i, 18C"i, 18B"i) are also added with the purpose of increasing the transport capacity, since they allow that a vehicle leaves in normal direction from a determined station towards the next one without the latter being necessarily unoccupied.

Under these circumstances, vehicle (1A) can leave station (9A) towards station (9B) with vehicle (1B) still stopped thereat. To that end, it is established a propulsion circuit from section isolation valve (17A or 17A') to section isolation valve (17B), all of them in shut position and locked, using atmospheric valve (18B") in open position for performing air exhaust to atmosphere.

As soon as station (9B) is cleared by the shutting of section isolation valve (17B') and the forward movement of vehicle (1B) to a new control block towards station (9C), section isolation valve (17B) and atmospheric valve (18B') are commanded to open, while atmospheric valve (18B") is commanded to shut, maintaining atmospheric valve (18B) shut, and consequently extending with total safety and comfort the propulsion circuit of vehicle (1A) still in full movement, allowing to reach passenger platform of station (9B).

Shunts at terminals are also favored by the inclusion of power propulsion units (10A and 10Ei), allowing, for example, that a vehicle parked at station (9E) moves to the end of guideway (6) by using the power propulsion unit (10D) in pressure mode, and returning over crossover (31Gd) in reverse position towards guideway (6*i*) up to station (9E) by action of power propulsion unit (10Ei) in suction mode. This at the same time making it possible that another vehicle moves concomitantly along the section located between station (9D) and station (9C) by the action of power propulsion unit (10Di) in guideway (6*i*).

In FIG. 11, the so-called shunt power propulsion units (10G and 10Fi) are added closed to terminal stations (9A and 9E), which main function is imparting agility to the return process in the pinched loop at the guideway (6 and 6*i*) ends. These new power propulsion units operate integrated with the newly equipped valves (18A", 18E', 18E", 18E'"i, 18A'i and 18A"i). On that account, the arrangement allows to incorporate two new vehicles, (1E and 1Ai).

Atmospheric valves (18A'", 18B'", 18C'", 18D'", 18E"i, 18D'"i, 18C'"i and 18B'"i) are further added for the purpose of:

a) Allowing operation of the track in normal direction in suction mode when necessary, without prejudice to the performance;

b) Allowing operation of the track in the reverse direction with the same performance as in the project original direction, also making it possible that a vehicle leaves from a determined station towards the next one, without the latter being unoccupied, matching the degraded operation to the normal operation;

c) Allowing the operation in coasting, activated in the cruise phase, when the respective power propulsion unit is put in stand-by mode, combined with the opening of atmospheric valve upstream and downstream the position of the vehicle in question, which will now move only by kinetic energy; and d) Utilizing upstream atmospheric valve to complement the atmospheric valve downstream for contributing in the regulation of vehicle pneumatic braking.

In scenario "a", vehicle (1A) departs from station (9A) towards station (9B), the latter being obligatorily unoccupied, by action of power propulsion unit (10B) in suction mode through connection duct (11B), the flow direction valve (29B') being open and the flow direction valve (29B) shut. To that end, atmospheric valve (18A) and section isolation valves (17A" and 17B) are commanded to open, section isolation valve (17A) and atmospheric valves (18A', 18A'", 18B) are commanded to shut, section isolation valves (17A' and 17B') remain open and atmospheric valves (18B' and 18B') and the section isolation valve (17B") remain shut. When vehicle (1A) passes the position of section isolation valve (17A"), atmospheric valve (18A'") is immediately commanded to open and section isolation valve (17A") is commanded to shut, thus releasing station (9A) for ingress of vehicle (1Ai) in shunt of guideway end, from guideway (6*i*) to guideway (6), by the action of power propulsion unit (10Fi) in pressure mode, or of power propulsion unit (10A) in suction mode, optionally.

In scenario "b", vehicle (1B) leaves station (9B) towards station (9A), in the reverse direction, with vehicle (1A) still stopped thereat. To that end, a propulsion circuit is formed from section isolation valve (17B") up to valve (17A"), both in shut and locked positions, using atmospheric valve (18A'") in open position for performing exhaust of air to atmosphere. When vehicle (1A) leaves station (9A) and with vehicle (1B) in full movement, propulsion circuit is then extended to newly shut section isolation valve (17A), upon the opening of atmospheric valve (18A) and section isolation valve (17A") and the shutting of atmospheric valve (18A'").

Shunts at terminals are also favored by the addition of power propulsion units (10G and 10Fi), allowing, for example, that vehicle (1E) parked in guideway (6) in the position of station (9E) moves towards the end of guideway by using power propulsion unit (10G) in suction mode. At the same time that, if necessary for purposes of traffic regulation, vehicle (1D) can move in the propulsion circuit delimited between section isolation valves (17D or 17D') and (17E), in shut and locked positions, with the exhaust of air through atmospheric valve (18E') in the open position, by action of power propulsion unit (10D) in pressure mode. To that end, atmospheric valve (18E") and section isolation valve (17E') are commanded to open, while atmospheric valve (18E) is commanded to shut. Atmospheric valve (18G) and section isolation valve (17Gd) are maintained shut, forming a propulsion circuit delimited by section isolation valve (17E) and duct end plug (30G). Crossover (31Gd) is maintained in the normal position. When vehicle (1E) reaches its correct position at the end of track, section isolation valves (17Gd and 17Ei) and atmospheric valve (18E'i) are commanded to open, while section isolation valve (17E') is commanded to shut. Atmospheric valves (18G, 18E'"i and 18Ei) and section isolation valves (17Gi and 17E"i) remain shut and crossover (31Gd) is put in reverse position, then vehicle (1E) is moved towards guideway (6*i*) by the action of power propulsion unit (10G) in pressure mode.

In FIG. 12, pneumatic propulsion system 2 receives the power propulsion units (10B', 10C', 10D', 10E, 10D'i, 10C'i, 10B'i and 10Ai), in order to activate the push-pull mode. This addition enables the operation with larger vehicles, increases the availability index of the system on account of the redundancy introduced in propulsion, as well as favors the maintenance thereof by allowing access to the machine rooms when they are not in use in the day period, during which the costs with personnel are smaller and the work conditions are better. Extra valves are not incorporated.

Vehicle (1A) leaves station (9A) towards station (9B), by the combined action of power propulsion unit (10A) in pressure mode and of power propulsion unit (10B') in suction mode. During the regime phase only one power propulsion unit (10A or 10B') continues to propel the vehicle, in case there is not any sharp slope in this section. The push-pull propulsion can be also utilized in the shunts of guideway switching, both in crossovers of terminals and in the intermediate crossovers.

FIG. 13 shows the most complete propulsion arrangement when there is not subdivision of the section, in which all the fittings' plugs for valve coupling are removed, to make room to the section isolation valves (17B'", 17C'", 17D'", 17E'", 17D'''i, 17C'''i, 17B'''i and 17A'''i), that, although optional, perform the side function of adding even more operational redundancy to the pneumatic transport system.

If, for example, power propulsion unit (10B) is, by any reason, unavailable for service, the push-pull propulsion in normal direction between station (9B) and station (9C) can take place by using power propulsion units (10B' and 10C') in a propulsion circuit delimited by section isolation valves (17B''' and 17C) in shut position.

FIG. 14 shows the typical propulsion arrangement containing an intermediate section between stations, based on the final configuration of FIG. 13. Intermediate sections are generally created whenever distance between two stations is more than approximately 1800 meters, or when it is necessary to operate with a very short interval between vehicles (headway) to increment the transport capacity of the pneumatic transport system, when enabling simultaneous traffic of multiple vehicles between stations, in total quantity equal to the number of intermediate sections.

In the most common case of two intermediate sections, the section between two stations is divided into three subsections (SUB1, SUB2 and SUB3) in guideway (6) and in the same three subsections (SUB1*i*, SUB2*i* and SUB3*i*) in guideway (6'), being the latter set just disposed in reverse in relation to the former set only on the basis that the vehicle is moving in the opposed direction. Subsection (SUB2) is a transition propulsion circuit which is sometimes connected to subsection (SUB1), other times to subsection (SUB2), therefore, never being independent.

In the normal movement direction, subsection (SUB1) has typically a length two thirds of that of subsection (SUB3), while subsection (SUB2) has only the remaining third part, assuring a balance in the distribution of trip times between intermediate sections. This way when a vehicle departs from a station towards another, it ideally moves within the block formed by the combination of subsection (SUB1) with subsection (SUB2), while the vehicle ahead moves exclusively in subsection (SUB3). One of the functions of subsection (SUB2) is to accommodate the possible variations in relation to the original schedule of vehicle traffic, disturbed by delays in stations and other external factors characteristic of mass transport systems.

Vehicle (1BC) departs from the station (9B) towards station (9C) by the simultaneous action of power propulsion unit (10B) in pressure mode and of power propulsion unit (10BC) in suction mode, releasing station (9B) for occupation by vehicle (1B), for boarding and landing of passengers. Vehicle (1BC), in the exemplified situation, is propelled in the section composed of only subsection (SUB1), delimited by section isolation valves (17B' and 17BC') in shut and locked positions, whenever vehicle (1BC') is still within section of subsection (SUB2) and travelling in the control block composed of the combination of subsection (SUB2) with the subsection (SUB3), delimited by section isolation valves (17BC' and 17C) in shut and locked positions, by the action of power propulsion unit (10C') in suction mode When vehicle (1BC') passes the position of section isolation valve (17BC''), vacating subsection (SUB2), atmospheric valve (18BC''') is commanded immediately to open and atmospheric valve (18BC') and section isolation valve (17BC'') are commanded to shut, after which vehicle (1BC') now moves exclusively in subsection (SUB3), leaving subsection (SUB2) free to combine with subsection (SUB1). At this moment, atmospheric valve (18BC'') and section isolation valve (17BC') are commanded to open so that vehicle (1BC) can safely ingress in subsection(SUB2), now under exclusive action of power propulsion unit (10B), since in the regime phase only one power propulsion unit is made necessary.

In the ideal case in which subsection (SUB2) is already unoccupied when vehicle (1BC) departs from station (9B), this will move directly in the domain located between subsections (SUB1 and SUB2), at the same time that vehicle (1BC') just ahead moves in subsection (SUB3).

In FIG. 15, power propulsion units (10BC' and 10BC'i) and respective section isolation valves (17BC''' and 17BC'''i) are added, which besides the obvious function of incrementing redundancy of the system, allow that subsection (SUB3), after the example of subsection (SUB1), have the option of push-pull propulsion available whenever necessary, either by imposition of the terrain altimetry, or by the option of assuring that the restoration of the operation in the section after an emergency stop occurs without losing performance. A secondary benefit concerns the operation of the vehicle in the control block formed by the combination of subsection (SUB1) with subsection (SUB2) taking place with the power propulsion unit localized at the end of propulsion circuit, thus preventing the volume of propulsion duct composed of (SUB2) from becoming a dead air chamber. That is, in such circumstances, vehicle (1 BC) departing from station (9B) towards station (9C) can accelerate by the simultaneous action of power propulsion units (10B and 10BC'). Power propulsion unit (10BC) would be only employed in this shunt in the accidental unavailability of power propulsion unit (10BC').

The invention claimed is:

1. A pneumatic propulsion system for high capacity transport of passengers and/or cargo comprising vehicles provided with trucks, each with four metallic wheels, having one of the axles connected to a pylon fixed to a propulsion plate, the vehicles moving over rails seated on the elevated guideways supported by pillars, and having at the top of the elevated guideways longitudinal slots for the passage of the pylons of propulsion plates, having along the path boarding and landing stations and power propulsion units which connection ducts are joined to the elevated guideway, being composed of a dual elevated guideway where two power propulsion units are installed for operation with propulsion in push and/or pull mode, one pair for each elevated guideway, for each traffic direction, the power propulsion units being connected to the elevated guideways;

the power propulsion units being installed inside machine rooms located in levels lower than those of platforms of the passenger boarding and landing stations;

having secondary propulsion ducts constructed in sections and in parallel with the propulsion ducts;

having a set of guideway section isolation valves positioned upstream and downstream the connection ducts of power propulsion units in propulsion ducts blocking the air flow in the corresponding section of guideways;

having a set of atmospheric valves which are positioned alongside the guideway section isolation valves for admitting or exhausting air in the corresponding section of elevated guideways;

having air flow control valves mounted between connection ducts and blowers; and having flow direction valves working in synchronism, and switching between fully open and fully shut positions between blowers and the guideway.

2. The pneumatic propulsion system for high capacity transport of passengers and/or cargo according to claim 1, wherein the air flow control valves are of the venetian blind type with parallel or opposed blades.

3. The pneumatic propulsion system for high capacity transport of passengers and/or cargo, according to claim 1, wherein the air flow control valves are of four types: pressure control valve, pressure security control valve, suction control valve and suction security control valve, the pressure control valve and suction control valve being responsible for air admission into the inlet of blower of power propulsion unit and the security control valves being responsible for air discharge at the outlet of blower of power propulsion unit.

4. The pneumatic propulsion system for high capacity transport of passengers and/or cargo, according to claim 1, wherein the admission and exhaust of air into the machine room taking place through acoustic attenuators.

5. The pneumatic propulsion system for high capacity transport of passengers and/or cargo, according to claim 1, wherein the power propulsion units are composed of a variable speed motor drive connected through elastic coupling to the industrial blower.

6. The pneumatic propulsion system for high capacity transport of passengers and/or cargo, according to claim 1, wherein the interconnection ducts are a set composed of two identical segments, the first segment being installed in the admission to the air inlet box and the second segment being mounted on the discharge mouth of blower, connected to a plenum which provides air convergence of air flow in the direction to connection duct for flowing to the propulsion duct and to a secondary duct segment for connection to the secondary propulsion duct.

7. The pneumatic propulsion system for high capacity transport of passengers and/or cargo, according to claim 1, wherein the flow direction valve is installed between the power propulsion unit and the propulsion duct and valve is installed between the power propulsion unit and the secondary propulsion duct.

* * * * *